US005984118A

United States Patent [19]

Morrow

[11] Patent Number: 5,984,118

[45] Date of Patent: Nov. 16, 1999

[54] PINCH-ACTUATED PRODUCT DISTRIBUTION SYSTEM

[75] Inventor: Lester A. Morrow, Plymouth, Minn.

[73] Assignee: Gage In-Store Marketing, LLC, Minneapolis, Minn.

[21] Appl. No.: 08/340,688

[22] Filed: Nov. 18, 1994

Related U.S. Application Data

[63] Continuation of application No. 08/054,675, Apr. 28, 1993, abandoned.

[51] Int. Cl.[6] ..... B42F 7/00

[52] U.S. Cl. ..... 211/59.1; 248/220.4; 248/221.4

[58] Field of Search ..... 211/59.1, 57.1, 211/54.1; 248/221.4, 222.1, 221.3, 220.3, 220.4, 222.2, 221.1

[56] References Cited

U.S. PATENT DOCUMENTS

| | | | |
|---|---|---|---|
| 536,445 | 3/1895 | Rockwell | 211/59.1 |
| 829,332 | 8/1906 | Hammer . | |
| 1,411,252 | 4/1922 | Bassett et al. . | |
| 1,590,172 | 6/1926 | Thorberg . | |
| 1,590,591 | 6/1926 | Steffes . | |
| 1,644,155 | 10/1927 | Scott . | |
| 2,787,435 | 4/1957 | Shields . | |
| 2,842,264 | 7/1958 | Larson . | |
| 2,906,410 | 9/1959 | McGuire . | |
| 2,925,239 | 2/1960 | Luck . | |
| 3,374,898 | 3/1968 | Karmin . | |
| 3,481,482 | 12/1969 | Wilkens . | |
| 3,677,415 | 7/1972 | Radek . | |
| 3,715,096 | 2/1973 | Filbert | 248/220.4 |
| 3,785,501 | 1/1974 | Canning . | |
| 3,861,631 | 1/1975 | Shorin | 248/218.1 |
| 3,934,727 | 1/1976 | Brefka . | |
| 4,016,977 | 4/1977 | Krautsack . | |
| 4,059,190 | 11/1977 | Conway . | |
| 4,106,734 | 8/1978 | Walitalo | 248/100 |
| 4,109,795 | 8/1978 | Konigsford et al. | 211/57.1 |
| 4,258,892 | 3/1981 | Craine | 248/220.4 |
| 4,300,684 | 11/1981 | Smith et al. . | |
| 4,362,249 | 12/1982 | Thalenfeld . | |
| 4,394,909 | 7/1983 | Valiulis et al. | 211/59.1 |
| 4,434,960 | 3/1984 | Berry | 248/220.4 |
| 4,463,510 | 8/1984 | Windish | 211/59.1 X |
| 4,474,300 | 10/1984 | Entis | 211/57.1 |
| 4,483,502 | 11/1984 | Fast | 248/222.1 |
| 4,516,681 | 5/1985 | Jahel | 211/59.1 |
| 4,541,598 | 9/1985 | Villanueva et al. | 248/221.4 |
| 4,572,380 | 2/1986 | Langwell | 248/221.4 X |
| 4,688,683 | 8/1987 | Thalenfeld et al. | 211/57.1 |
| 4,832,207 | 5/1989 | Alexander | 211/57.1 |
| 4,850,557 | 7/1989 | Valiulis | 248/220.4 |
| 4,871,135 | 10/1989 | Thalenfeld | 248/221.4 |
| 4,889,304 | 12/1989 | Glickman et al. | 248/222.12 |
| 4,907,774 | 3/1990 | Shaw et al. | 248/306 |

(List continued on next page.)

FOREIGN PATENT DOCUMENTS

| | | |
|---|---|---|
| 2489792 | 3/1982 | France . |
| 2250982 | 6/1992 | United Kingdom . |

OTHER PUBLICATIONS

New Line of Plastic Hooks from Trion, Trion Industries Inc., 1992.

*Primary Examiner*—Ramon O. Ramirez
*Attorney, Agent, or Firm*—Merchant & Gould P.C.

[57] ABSTRACT

An anti-pilfer product display apparatus supports a product package to display the package and inhibit shoplifting. A support member has a cross section which is substantially the same as an orifice formed in the product package. The support member inserts through the orifice to support the package. The support member includes an enlarged cross section portion which prevents the packages from being slid from the end of the support member. The enlarged section is compressible to a configuration wherein the enlarged cross section may be slid through the orifice so that product packages may be removed. The support member also includes an attachment member for attaching to a mounting surface. The support member and the attachment member coact to prevent the support member from being pulled directly from the mounting surface.

2 Claims, 4 Drawing Sheets

U.S. PATENT DOCUMENTS

| | | | |
|---|---|---|---|
| 4,941,632 | 7/1990 | Couls et al. | 248/221.2 |
| 4,974,798 | 12/1990 | Harding et al. | 248/73 |
| 5,009,334 | 4/1991 | Bodkins | 211/54.1 |
| 5,014,949 | 5/1991 | Niven | 248/220.4 |
| 5,060,897 | 10/1991 | Thalenfeld | 248/220.4 |
| 5,080,238 | 1/1992 | Hochman | 248/220.4 X |
| 5,088,606 | 2/1992 | Boas | 211/57.1 |
| 5,114,021 | 5/1992 | Fredrickson | 211/54.1 |
| 5,123,189 | 6/1992 | Fast et al. | 40/299 |
| 5,144,345 | 9/1992 | Nyman | 211/59.1 |
| 5,375,725 | 12/1994 | Rosenthal | 211/59.1 |

FIG. 1
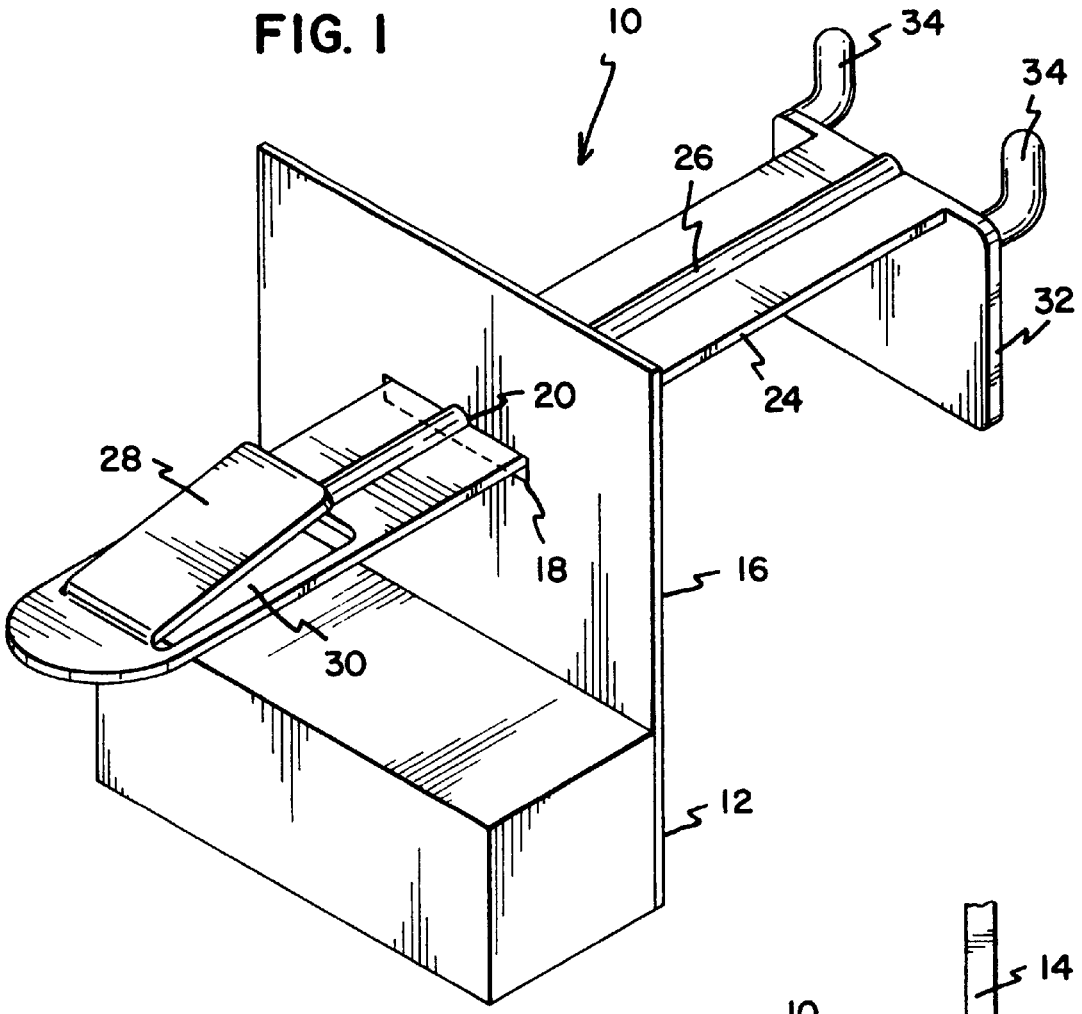
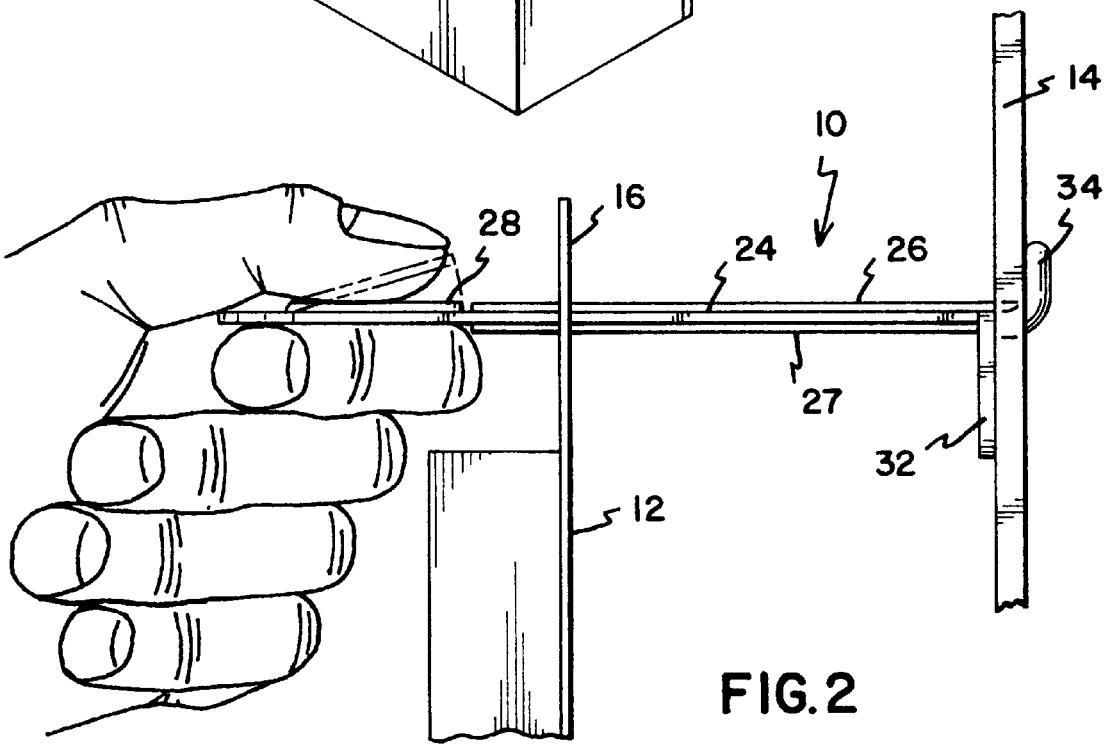
FIG. 2

PINCH-ACTUATED PRODUCT DISTRIBUTION SYSTEM

This is a Continuation of application Ser. No. 08/054, 675, filed Apr. 28, 1993, now abandoned.

BACKGROUND OF THE INVENTION

1. Field of the Invention

The present invention is directed to an anti-pilfer package support system such as is used for retail displays.

2. Description of the Prior Art

Many types of products are supported on hooks with a plurality of like products aligned on each hook in retail displays. A slumber of hooks may be supported on pegboard or other surfaces to provide support for a wide selection of products. Products typically have a flap member extending from the package which has an orifice through which a hook or other support member is inserted to support the package.

A common problem with packages supported on hooks is the ease with which the products may be stolen or may fall off the end of the display hook and be damaged. Shoplifting is often a large problem for stores and adds greatly to the cost for security and the cost for lost or stolen merchandise. Products supported on the hooks may be slid from the extended end and easily taken. In addition, problems are encountered with "sweeping the hook" wherein all packages supported on the hook are pushed forward off the end of the support. To mount or remove the support, it is usually pivoted upward, so that tabs may be inserted into holes in the pegboard. This allows the hooks to be stolen with the products still supported and presents an additional security problem.

Efforts to provide a support for displaying products while allowing them to be removed without undue effort by the customer, yet difficult to shoplift, have not proven to be satisfactory. Prior devices typically do not prevent shoplifting from easily occurring or cause an undue burden for the purchaser trying to remove the product, so that sales may be affected from additional time and effort required for selecting and removing a single product package. Additional time may also be required when stocking the hooks as the pilfer-resistant displays are often difficult to load.

It can be seen then, that an apparatus is needed which allows customers to easily remove one item at a time, yet inhibits theft of multiple items from displays in stores. Such a device should support the packages in a manner which prevents easy removal of all products while not causing an undue burden on the consumers who wish to purchase a product.

SUMMARY OF THE INVENTION

The present invention is directed to a support apparatus for supporting retail products in a manner which inhibits shoplifting. A support member extends through an orifice formed in a portion of the product package in a manner to support the package. The orifice in the package has a cross section which is configured to allow the support member to extend therethrough. The support member also includes a portion having an enlarged cross section which prevents the product package from passing beyond the enlarged section. The enlarged section is flexible and may be compressed to allow the package to be slid past the enlarged section.

The present invention also includes embodiments which prevent the support member from being pulled from a mounting surface. The support member may be configured so that it cannot be easily tipped up to allow removal from the pegboard.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views:

FIG. 1 shows a perspective view of a first embodiment of the present invention supporting a product package;

FIG. 2 shows a side elevational view of the support apparatus shown in FIG. 1 mounted to a pegboard;

DETAILED DESCRIPTION OF THE PREFERRED EMBODIMENT(S)

Figure 3:
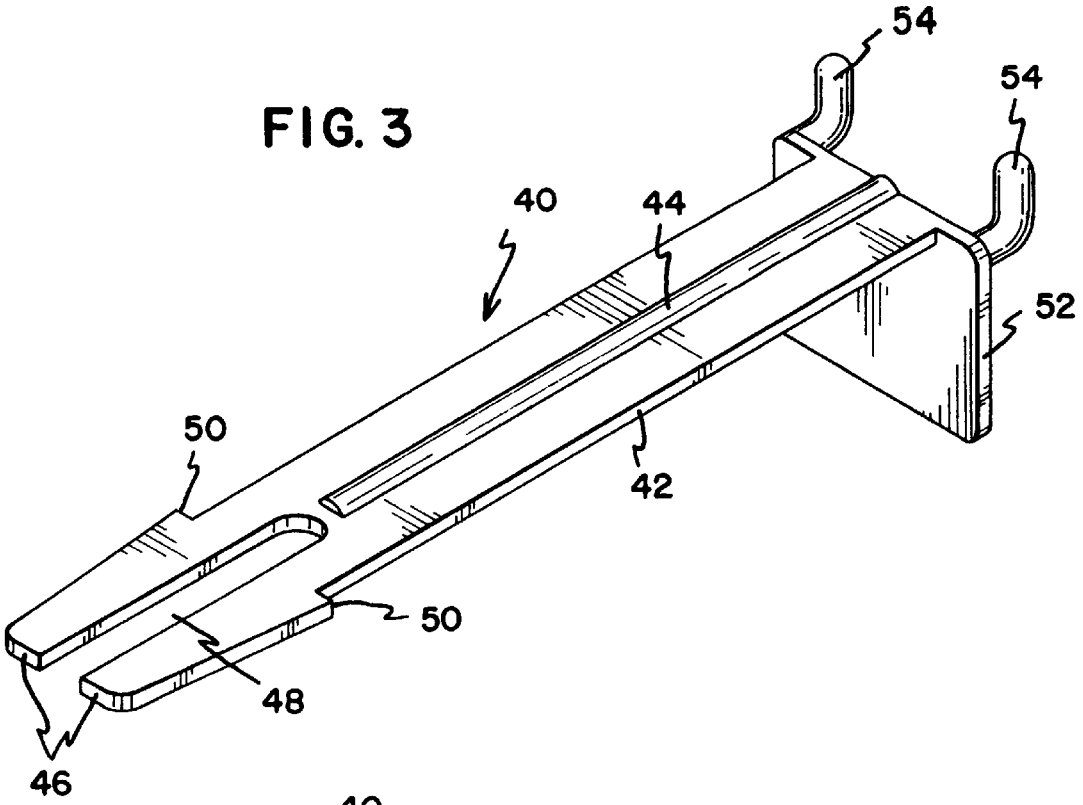
FIG. 3 shows a perspective view of a second embodiment of a support member according to the principles of the present invention.

Referring now to the drawings, and in particular to FIG. 1, there is shown a pilfer-proof support member, generally designated 10. The support member 10 supports a product package 12. The support member 10 hooks into pegboard 14 or other surfaces, as shown in FIG. 2. The product package 12 typically includes a flap 16 having an orifice 18 formed therein for receiving a planar portion 24 of the support member 10. In the embodiment shown, the orifice 18 includes a groove 20 to receive a ridge 26, as shown in FIG. 1. The support device 10 may also include a lower ridge 27 as shown in FIG. 2. The support member 10 connects into pegboard 14 by means of hooks 34 sliding into holes formed in the pegboard. The support member 10 has a plate 32 which rests against the pegboard 14, as shown in FIG. 2 to support the planar portion 24 in a substantially horizontal position. The support member 10 includes a tab 28 which is off-set from the planar portion 24 of the support member 10. An orifice 30 is formed in the planar portion 24 below the tab 28 and configured to receive the tab, which is flexibly connected to the support member 10 to pivot. The hinged configuration allows the tab 28 to be depressed, as shown in FIG. 2.

When the tab 28 is in the normal raised position, as shown in FIG. 1, the product packages 12 are prevented from being removed from the support member 10 as the orifice 18 is not large enough to allow the raised tab 28 to slide through. Therefore, the flap 16 would engage the raised tab 28 when the package is urged toward the extended end of the planar portion 24. This prevents the products 12 from accidentally sliding off the end of the support member 10 or from being pulled off the end of the support member. However, when the packages 12 are placed on the support member 10, the tab 28 is depressed as the flap 16 is pushed over the tab.

Figure 4:
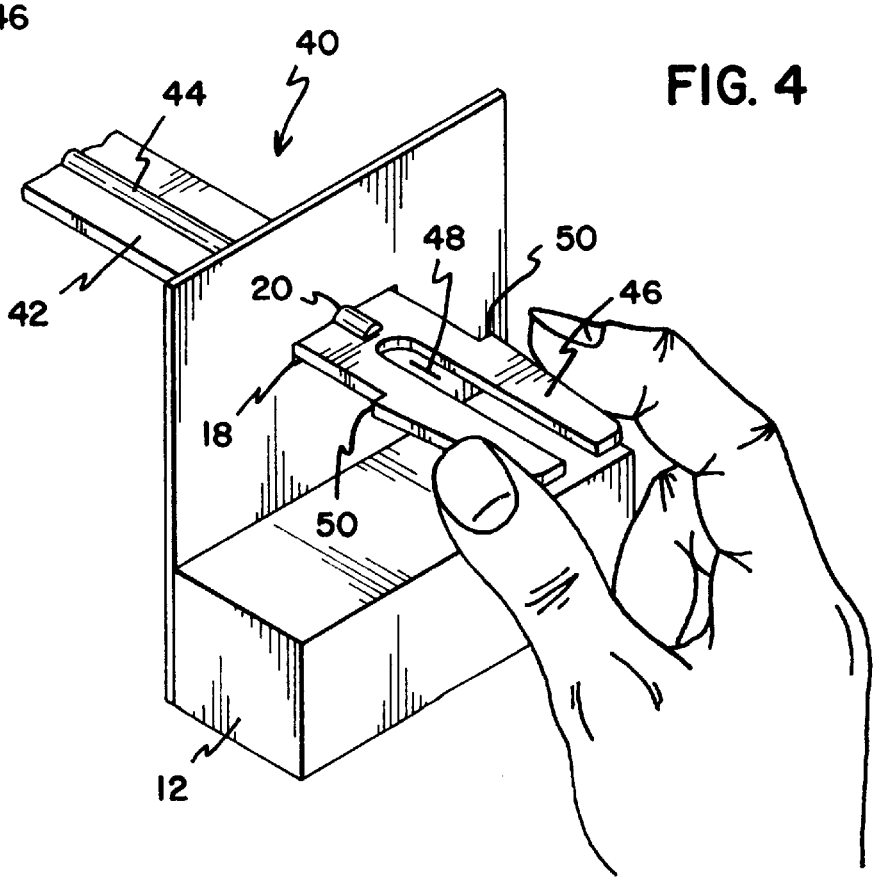
FIG. 4 shows a perspective view of the support member shown in FIG. 3 with a product package supported thereon.
Figure 5:
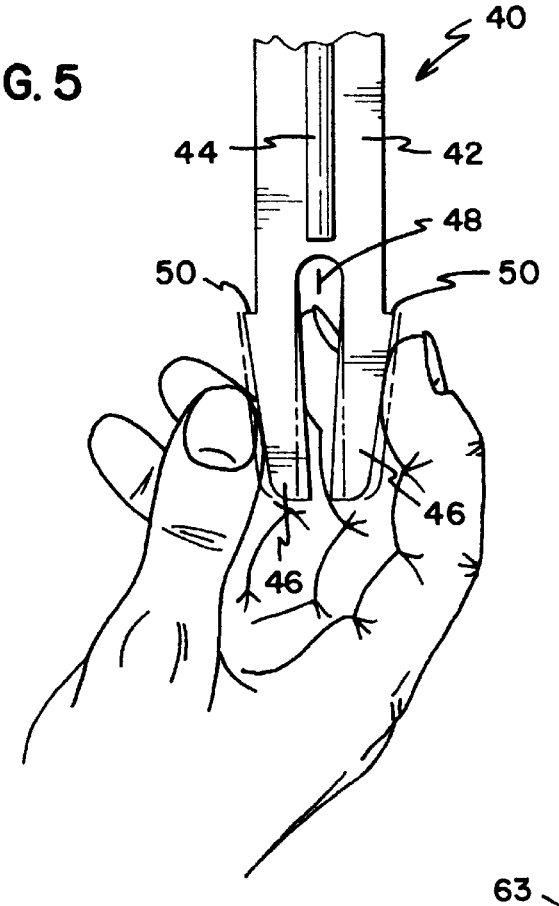
FIG. 5 shows a top plan view of an end portion of the support member shown in FIG. 3 with pinch members pushed together to allow a package to pass over the pinch members.

Referring now to FIGS. 3–5, there is shown a second embodiment of the support member, generally designated 40. The support member 40 includes a planar portion 42 which is substantially horizontal when supported and may include a top ridge 44. The planar portion 42 extends from a substantially vertical plate 52 having a pair of hooks 54 extending therefrom for engagement with a pegboard in a manner similar to that of the first embodiment, as shown in FIG. 2. Referring again to FIG. 3, at an end of the planar member 42 are a pair of opposed pinch members 46. A space 48 is formed between the pinch members 46 so that the members may be forced together, as shown in FIG. 5. The ends of the pinch members closest to the mounting plate 52 are widened and form notches 50. As shown in FIG. 4, the width of the orifice 18 is approximately the same as the width of the planar member 42, but less than the width of the widest portion of the pinch members 46. Therefore the notched portions 50 engage the sides of the flap 16 of the product 12 to prevent the product from being slid from the end of the planar member.

However, when the pinch members 46 are pinched together, as shown in FIG. 5, the widest portions proximate the notches 50 are narrowed. This allows the product to pass over the notch portions 50 and be removed from the support member 40. The pinch members 46 are narrowed at the extended end and slant wider towards the notch portions 50. The gradual increase in width allows the product 12 to be slid on and also will push the pinch members 46 inward so that the product package 12 may be slid onto the planar member 24 past the widened notch portions 50. However, when the product package 12 is supported, there is no gradual widening of the planar member 42 proximate the notch portions 50 toward the extended end of the planar member 24. Therefore, the products 12 engaging the notch portions 50 are prevented from sliding off the end of the support member 40, unless the members 46 are pinched together.

Figure 6:
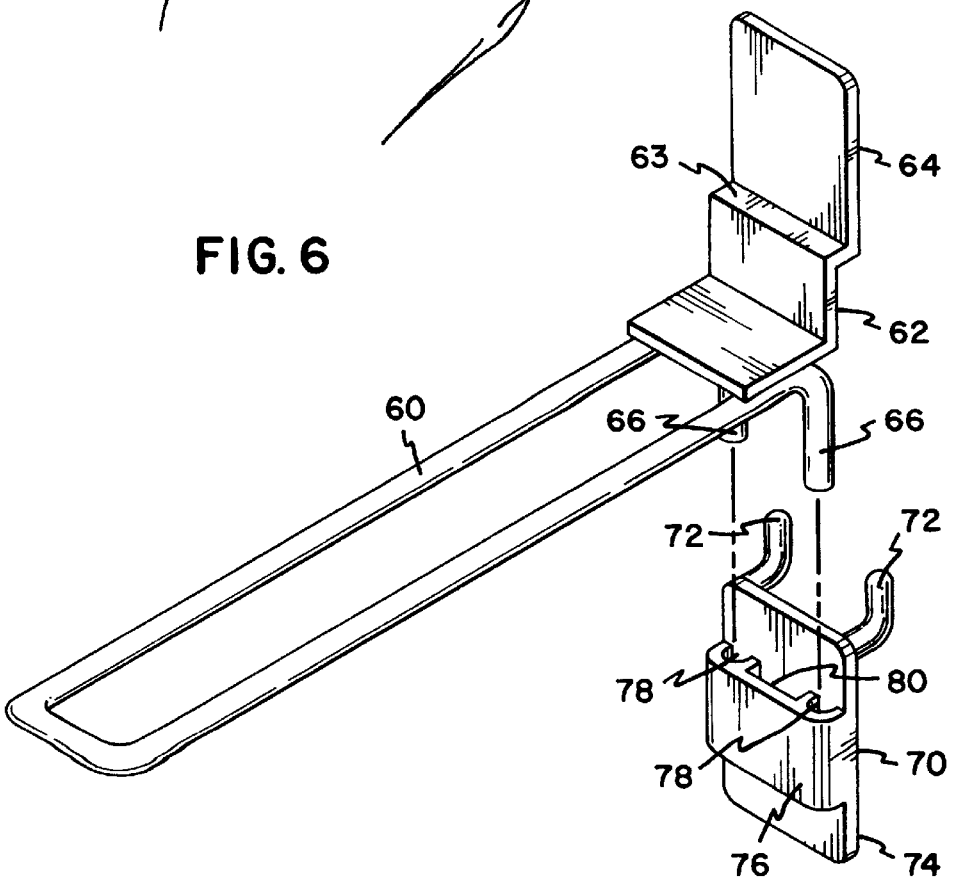
FIG. 6 shows a perspective exploded view of an alternative embodiment of the present invention.
Figure 7:
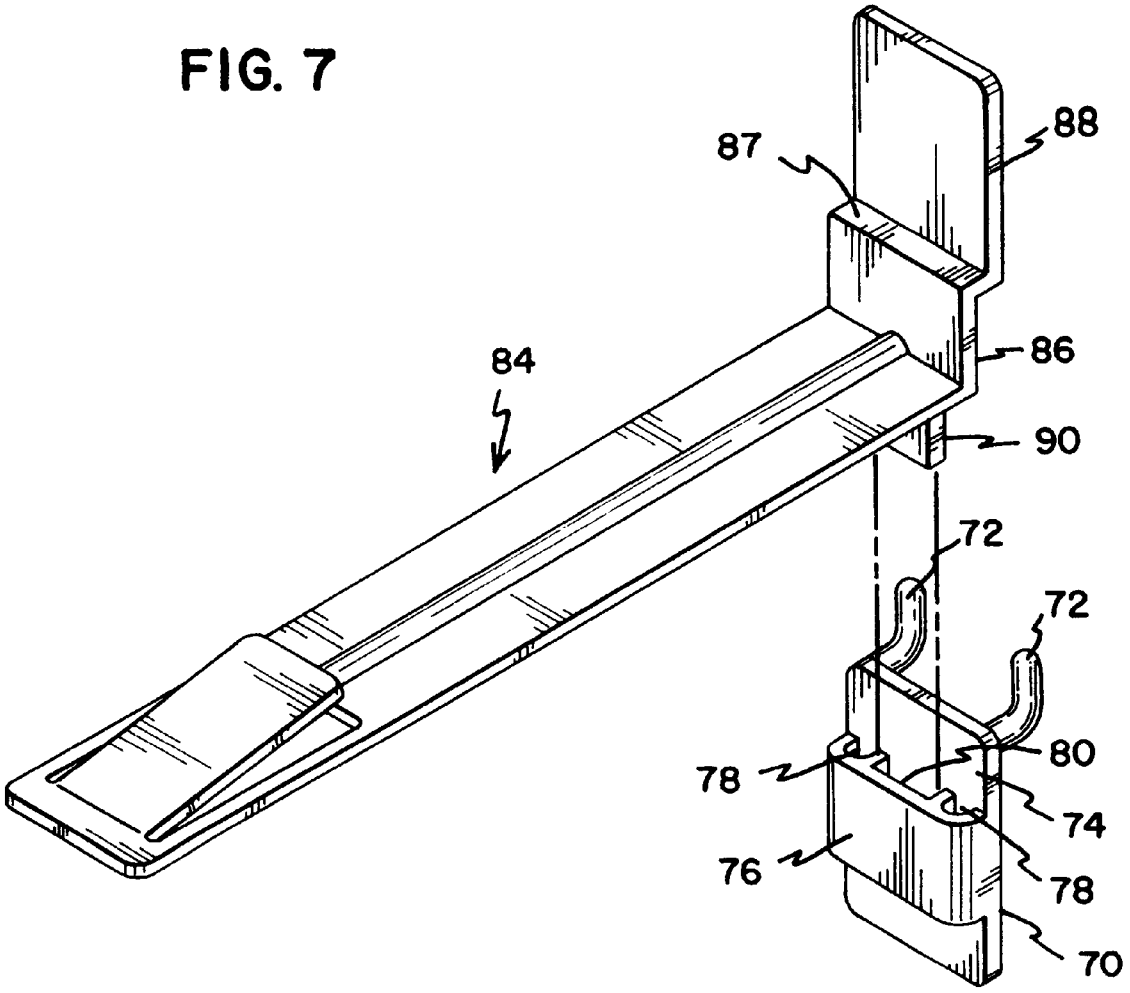
FIG. 7 shows a perspective exploded view of an alternative embodiment of the present invention.

Referring now to FIGS. 6 and 7, there are shown two embodiments of the present invention which incorporate an anti-pilfer device to prevent the support member from being pulled from the pegboard or other support surface. The support member 60, shown in FIG. 6, mounts to an attachment member 70. The attachment member 70 includes hooks 72 which engage holes in the pegboard. A plate 74 engages the forward outer surface of the pegboard when mounted. A bracket 76 extends from the plate 74 and forms a central slot 80 and orifices 78 at each side of the slot 80. The support member 60 includes a rear plate 62 and a ledge 63 extending rearward from an upper portion of the plate 62. A recessed plate 64 extends upward vertically from the rearward portion of the ledge 63. A pair of rods 66 extend vertically downward from the rear of the support member 60 below the plate 62.

To mount the support member to the pegboard, attachment member 70 is mounted to the pegboard by tipping it upward so that the hooks 72 can slide through the holes in the pegboard. When the hooks 72 have extended through to the rear of the pegboard, the plate 74 is substantially vertical and it engages the front surface of the pegboard. The support member 60 is then mounted on the attachment member 70. The rods 66 are slid through the orifices 78 until the ledge 63 engages the top portion of the plate 64. At this position, the recessed plate 64 of the support member 60 is also in engagement of the front surface of the pegboard. The attachment between the rods 66 and the orifices 78 along with the plate 64 engaging the pegboard prevent the attachment member 70 from being rotated upward so that the hooks 72 may not be slid from the holes of the pegboard. In addition, the rods 66 extending into the orifices 78 prevent the support member 60 from being pulled directly outward from the pegboard. It can be appreciated that in this manner, the support member 60 may not be removed without first lifting it from the attachment member 70. This prevents pilfering of the entire support as could occur with prior support devices.

As shown in FIG. 7, in a similar manner, a support member 84 includes a rear plate 86, a ledge 87 and a recessed plate 88. In addition, a vertical tab 90 extends downward from the bottom of the support member 84 proximate the rear plate 86. In this embodiment, a tab 90 is slid through the central slot 80 of the attachment member 70. The bracket 76 retains the tab 90 in the slot 80. The relationship between the tab 90 in the slot 80 and the recessed plate 88 engaging the front surface of the pegboard prevent the attachment member 70 from being rotated and pivoted upward so that the support hooks 72 may not be removed from the pegboard. In addition, the bracket 76 retaining the tab 90 in the slot 80 prevents the support member 84 from being pulled directly outward from the pegboard.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A one-piece hook for the display and dispensing of articles of the type which have holes for suspending the articles from the hook, the hook comprising a generally flat elongated hook body with an upper surface defining a plane, a pair of spaced upwardly crooked fingers formed at and extending beyond and upwards from an inner end of the hook body for securing the hook to a vertical surface so that the hook body extends horizontally and generally perpendicular to the vertical surface for suspending a plurality of articles, a support element extending downwards from said inner end for supporting the hook, and a depressible resilient tongue member which protrudes out of the horizontal plane defined by the surface of the hook body and extends rearwards toward the inner end, whereby the tongue member must be depressed toward said plane to remove an article from the hook.

2. A one-piece hook for the display and dispensing of articles of the type which have holes for suspending the articles from the hook, the hook comprising a generally flat elongated hook body with an upper surface defining a plane, a pair of spaced upwardly crooked fingers formed at and extending beyond and upwards from an inner end of the hook body for securing the hook to a vertical surface so that the hook body extends horizontally and generally perpendicular to the vertical surface for suspending a plurality of articles, a support element extending downwards from said inner end for supporting the hook, and a depressible resilient tongue member which protrudes out of the horizontal plane defined by the surface of the hook body and extends rearwards toward the inner end, wherein the hook includes an aperture formed in the hook body and wherein the tongue member overlies said aperture, whereby the tongue member must be depressed toward said plane to remove an article from the hook.

* * * * *